US006010350A

United States Patent [19]

Henrici et al.

[11] Patent Number: 6,010,350

[45] Date of Patent: Jan. 4, 2000

[54] SOCKET FOR TURN-AND-LOCK MULTIPIN ELECTRICAL DEVICE

[75] Inventors: Dieter Henrici; Herbert Beleke, both of Arnsberg, Germany

[73] Assignee: Brokelmann, Jaeger & Busse, GmbH & Co., Arnsberg, Germany

[21] Appl. No.: 09/057,639

[22] Filed: Apr. 9, 1998

[30] Foreign Application Priority Data

Apr. 10, 1997 [DE] Germany ..... 197 14 874

[51] Int. Cl.[7] ..... H01R 4/50

[52] U.S. Cl. ..... 439/337

[58] Field of Search ..... 439/337, 241, 439/226, 227, 240, 673, 671

[56] References Cited

U.S. PATENT DOCUMENTS

| | | | |
|---|---|---|---|
| 3,363,217 | 1/1968 | Garver et al. | 439/337 |
| 5,029,973 | 7/1991 | Rink | 350/96.21 |
| 5,542,857 | 8/1996 | Hume et al. | 439/337 |

FOREIGN PATENT DOCUMENTS

| | | |
|---|---|---|
| 15 89 233 | 4/1970 | Germany . |
| 296 12 393 | 10/1996 | Germany . |

*Primary Examiner*—Neil Abrams
*Assistant Examiner*—Eugene G. Byrd
*Attorney, Agent, or Firm*—Herbert Dubno; Andrew Wilford

[57] ABSTRACT

An electrical device having a base from which extend two parallel connector pins each having a small-diameter shank and a large-diameter head is fittable with a socket having a housing formed with a transverse wall having front and back faces and having between the faces a predetermined thickness substantially less than a distance between an end face of the device and the heads. The wall is formed with a pair of throughgoing slots each having a wide end through which a respective one of the heads can pass and an opposite narrow end so that the device can be fitted to the housing by passing the heads of the pins through the wide ends until the device end face engages the wall front face followed by turning of the device to displace the heads toward the narrow ends of the respective slots. A respective ramp at each of slots adjacent the respective narrow end is engageable with an underside of the respective head and is angled such that, on movement of the respective pin toward the respective narrow end, the respective head is cammed backward away from the wall back face and the device end face is pressed against the wall front face. Respective electrical contacts on the housing at the slots engage the heads of the respective pins when same are at the narrow slot ends.

9 Claims, 1 Drawing Sheet

SOCKET FOR TURN-AND-LOCK MULTIPIN ELECTRICAL DEVICE

FIELD OF THE INVENTION

The present invention relates to a socket for a turn-and-lock multipin electrical device. More particularly this invention concerns a socket for a turn- or twist-and-lock light bulb, fluorescent starter, or the like.

BACKGROUND OF THE INVENTION

It is known to provide an electrical device such as a fluorescent-lamp starter or a lamp, typically a halogen, with a twist- or turn-and-lock (TAL) base that comprises at least two pins that project parallel to each other from the device. Each pin has a small-diameter cylindrical shaft and a large-diameter cylindrical head and is made of metal, normally copper, for forming a good electrical contact to feed electricity to or through the device.

As described in German utility model 296 12 393 of E. Halemeier and German patent 1,589,233 of P. Rausseck the standard socket for such a device has a housing formed with a transverse wall having front and back faces. This wall is formed with a pair of throughgoing slots each having a wide end through which a respective one of the heads can pass and an opposite narrow end. Thus the device can be fitted to the housing by passing the heads of the pins through the wide ends followed by turning of the device to displace the heads toward the narrow ends of the respective slots which normally are formed as arcs with a common center of curvature. Respective electrical contacts on the housing at the slots engage the heads of the respective pins when same are at the narrow slot ends. Thus such a system is advantageous in that the device can be mounted or removed by a simple axial movement followed by or preceding an angular movement which is much simpler than screwing in the device.

Although the TAL base is of standardized size, with the pins set 7 mm apart for halogen lamps and 12.5 mm apart for starters, it is standard for the manufacturer of the socket to dimension the slotted end wall of the socket so that it has between its front and back faces a predetermined thickness substantially less than a distance between an end face of the device and the heads. This ensures that, even if the device is made to somewhat sloppy tolerances, it can be fitted to and locked in the socket. The normal tolerances for the contact pins is 0.2 mm and for the normally ceramic socket 0.3 mm. Thus the device is often a loose fit in the socket, something that is compounded when, as is common, the socket is made of ceramic material that shrinks somewhat over time when heated, often as much as 15%. The result is a loose fit that not only can leave a lamp off-center in its fixture, but that can actually come loose.

The terminals are often constituted with some spring action so as to radially retain the pins in place. While such spring-type terminals are often some help in retaining the device in the socket, they do not compensate out any poor fit caused by the difference between the spacing from the device end face to the head underside and the thickness of the slotted wall.

OBJECTS OF THE INVENTION

It is therefore an object of the present invention to provide an improved socket for a TAL electrical device.

Another object is the provision of such an improved socket for a TAL electrical device which overcomes the above-given disadvantages, that is which ensures a solid mounting and snug fit of the device under all circumstances.

SUMMARY OF THE INVENTION

An electrical device having a base from which extend two parallel connector pins each having a small-diameter shank and a large-diameter head is fittable with a socket having according to the invention a housing formed with a transverse wall having front and back faces and having between the faces a predetermined thickness substantially less than a distance between an end face of the device and the heads. The wall is formed with a pair of throughgoing slots each having a wide end through which a respective one of the heads can pass and an opposite narrow end so that the device can be fitted to the housing by passing the heads of the pins through the wide ends until the device end face engages the wall front face followed by turning of the device to displace the heads toward the narrow ends of the respective slots. A respective ramp at each of slots adjacent the respective narrow end is engageable with an under-side of the respective head and is angled such that, on movement of the respective pin toward the respective narrow end, the respective head is cammed backward away from the wall back face and the device end face is pressed against the wall front face. Respective electrical contacts on the housing at the slots engage the heads of the respective pins when same are at the narrow slot ends.

Thus with this system the ramps ensure a solid mounting of the device in the socket. There is ample play between the heads and the back face of the wall when the device is inserted, but when it is turned home the ramps come into action to eliminate this play and ensure a solid connection.

The socket and base according to the invention are centered when fitted together on a common axis and the pins and slots symmetrically flank the axis. The slots are circularly arcuate with centers of curvature at the axis. Each ramp is located at the respective narrow end. Furthermore each ramp is unitarily formed with the wall and the socket in turn is unitarily formed with the wall.

In accordance with the invention a respective spring urges each contact toward the respective slot. More particularly each contact is a metallic strip extending along the respective slot and each spring engages the respective strip generally centrally. Thus each strip is able to rock on the respective spring between a position bearing on the respective pin toward the respective wide end and a position bearing on the respective pin toward the respective narrow end. It is also possible for each contact to be unitarily formed as a spring and bear toward the respective slot on the respective pin.

BRIEF DESCRIPTION OF THE DRAWING

The above a other objects, features, and advantages will become more readily apparent from the following description, reference being made to the accompanying drawing in which.

SPECIFIC DESCRIPTION

Figure 1:
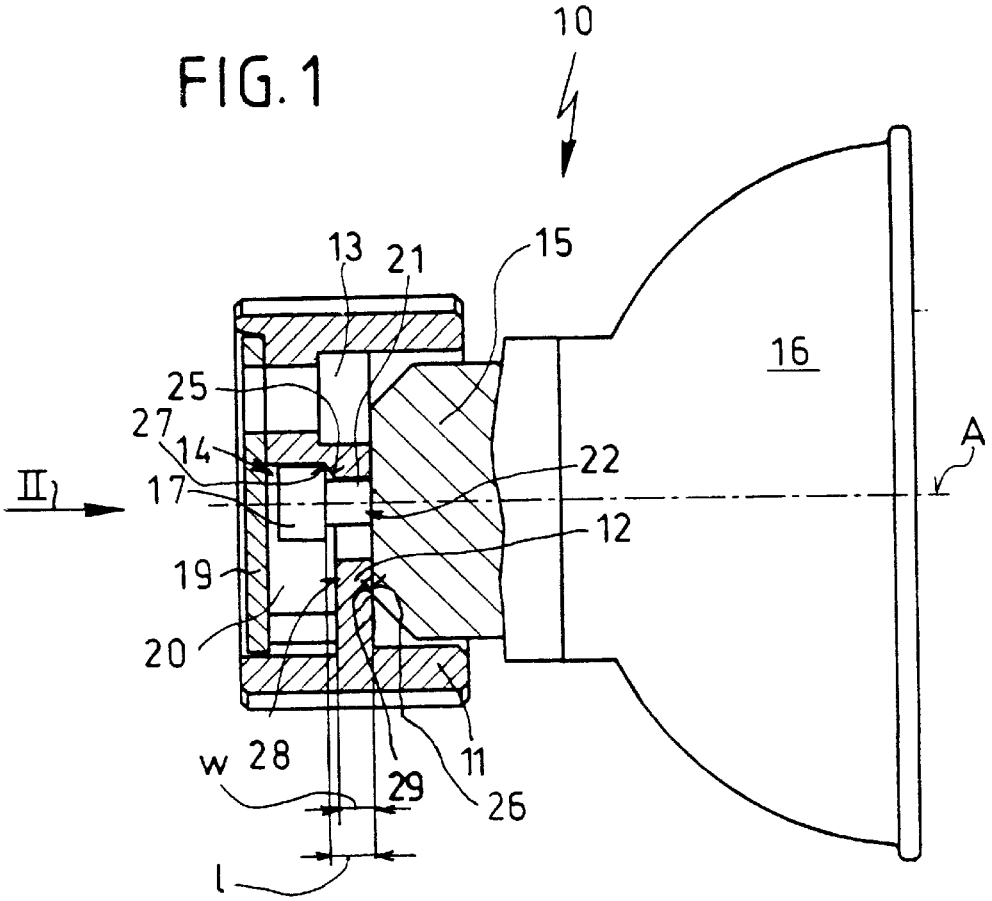
FIG. 1 is a side view partly in axial section through the assembly according to the invention.

As seen in the drawing, a lamp assembly 10 basically comprises a cup-shaped socket 11 having a transverse wall 12 and a lamp 16 having a base 15, all basically centered on or symmetrical to a common axis A when fitted together. A pair of pins 14 project axially from an end face 29 of the base 15, symmetrically flanking the axis A. Each pin 14 has a small-diameter cylindrical shaft 21 and a coaxial large-diameter cylindrical head 17. The head 17 has an annular inside or front face 27 that is spaced by a predetermined distance 1 from a back or end face 29 of the base 15.

The socket 11 is basically cylindrical and its wall 12 has a front face 26 and, parallel thereto, a back face 28 to define a wall thickness w that is somewhat less than the distance 1. A rear cover 19 defines with the back face 28 a contact-holding compartment 20. This wall 12 is formed with a pair of identical arcuate and axially throughgoing slots 13 that symmetrically flank the axis A and that are each of keyhole shape, with a large-diameter end 18 and a small-diameter end 22. An electrical contact strip 24 extending secantally of the axis A is provided at each slot 13 and is urged radially centrally inward thereof by a respective compression spring 23 that engages the respective contact 24 centrally of the respective slot 13, permitting the contact 24 to rock somewhat.

Normally the lamp 16 is fitted to the socket 12 by passing the heads 17 through the large-diameter ends 18 of the slots 13 until the base end face 29 engages the wall front face 26 and then twisting the lamp 16 about the axis A to move these heads 17 to the narrow ends 22 of the slots 13. The width of the slots 13 offset from their wide ends 18 is substantially less than the diameter of the head 17 but slightly more than the diameter of the shaft 21 so that, once the heads 17 move away from the wide ends 18, they are captured in the space 20 and the lamp 16 cannot be withdrawn axially forwardly (to the right in FIG. 1) from the socket 12.

According to the invention the wall 12 is formed at the narrow end 22 of each slot 13 on the back face 28 with an axially and angularly directed ramp 25 that is angled such that it will engage under the face 27 of the respective head 18 and cam it axially back (to the left in FIG. 1), thereby pulling the end face 29 of the base 15 solidly into contact with the front face 26 of the wall 12. Thus the axial rise of this ramp 25 is roughly equal to or slightly more than the difference between the wall thickness w and distance 1 so that once the lamp 16 is twisted home, it will be solidly secured to the socket 11.

The central engagement of the springs 23 on the contact strips 24 creates a toggle action as the pins 14 move from the wide ends 18 to the narrow ends 22. Once they pass the centers of the grooves 13, these pins 14 are actually pushed by the springs 23. Thus as the bulb 16 is installed it will be held in place by spring force, and as it is removed this same spring force will work oppositely to urge the pins 14 to the wide ends 18.

Figure 2:
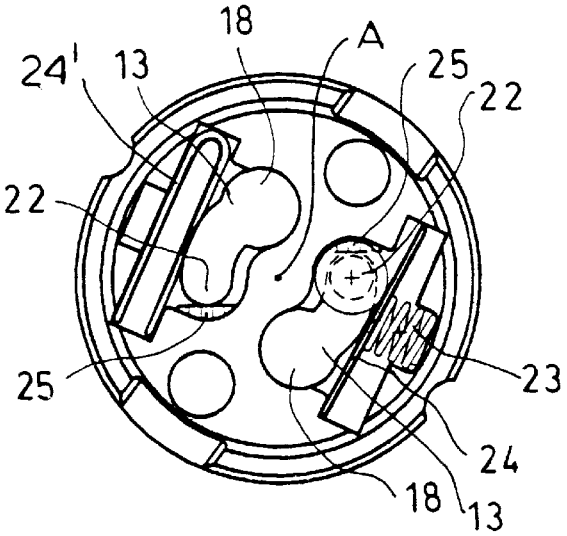
FIG. 2 is a rear view with a part removed for clarity of view of the socket.

FIG. 2 also shows a contact 24' that is itself a spring. It is U-shaped and formed of copper-coated spring steel so that its one leg bears against the pin and the opposite leg against the socket body.

We claim:

1. In combination with an electrical device having a base from which extend two parallel connector pins each having a small-diameter shank and a large-diameter head, a socket comprising:

a housing formed with a transverse wall having front and back faces, the wall having between the faces a predetermined thickness substantially less than a distance between an end face of the device and the heads, the wall being formed with a pair of throughgoing slots each having a wide end through which a respective one of the heads can pass and an opposite narrow end, whereby the device can be fitted to the housing by passing the heads of the pins through the wide ends until the device end face engages the wall front face followed by turning of the device to displace the heads toward the narrow ends of the respective slots;

a respective ramp at each of slots adjacent the respective narrow end, engageable with an underside of the respective head, and angled such that, on movement of the respective pin toward the respective narrow end, the respective head is cammed backward away from the wall back face and the device end face is pressed against the wall front face; and respective electrical contacts on the housing at the slots engageable with the heads of the respective pins when same are at the narrow slot ends.

2. The socket defined in claim 1 wherein the socket and base are centered when fitted together on a common axis and the pins and slots symmetrically flank the axis, the slots being circularly arcuate with centers of curvature at the axis.

3. The socket defined in claim 1 wherein each ramp is located at the respective narrow end.

4. The socket defined in claim 1 wherein each ramp is unitarily formed with the wall.

5. The socket defined in claim 4 wherein the socket is unitarily formed with the wall.

6. The socket defined in claim 1, further comprising a respective spring urging each contact toward the respective slot.

7. The socket defined in claim 6 wherein each contact is a metallic strip extending along the respective slot and each spring engages the respective strip generally centrally, each strip being able to rock on the respective spring between a position bearing on the respective pin toward the respective wide end and a position bearing on the respective pin toward the respective narrow end.

8. The socket defined in claim 1 wherein each contact is unitarily formed as a spring and bears toward the respective slot on the respective pin.

9. In combination with an electrical device having a base from which extend two parallel connector pins each having a small-diameter cylindrical shank and a large-diameter cylindrical head, a socket comprising:

a cup-shaped housing centered on an axis and formed with a transverse wall having front and back faces extending perpendicular to the axis, the wall having between the faces a predetermined thickness substantially less than a distance between an end face of the device and the heads, the wall being formed with a pair of arcuate throughgoing slots symmetrically flanking the axis and each having a wide end through which a respective one of the heads can pass and an opposite narrow end, whereby the device can be fitted to the housing by passing the heads of the pins through the wide ends until the device end face engages the wall front face followed by turning of the device about the axis to displace the heads toward the narrow ends of the respective slots;

a respective ramp at each of slots at the respective narrow end, engageable with an underside of the respective head, and angled such that, on angular movement of the respective pin toward the respective narrow end, the respective head is cammed axially backward away from the wall back face and the device end face is pressed against the wall front face;

respective electrical contacts on the housing at the slots engageable with the heads of the respective pins when same are at the narrow slot ends; and spring means urging each of the contacts radially across the respective slot.

* * * * *